US006041761A

United States Patent [19]

Uto et al.

[11] Patent Number: 6,041,761

[45] Date of Patent: Mar. 28, 2000

[54] EVAPORATIVE EMISSION CONTROL SYSTEM FOR INTERNAL COMBUSTION ENGINES

[75] Inventors: Hajime Uto; Toshiaki Ichitani; Yoshio Nuiya, all of Wako, Japan

[73] Assignee: Honda Giken Kogyo Kabushiki Kaisha, Tokyo, Japan

[21] Appl. No.: 09/085,884

[22] Filed: May 27, 1998

[30] Foreign Application Priority Data

May 30, 1997 [JP] Japan ..... 9-156166
May 30, 1997 [JP] Japan ..... 9-156167

[51] Int. Cl.[7] ..... F02M 37/04

[52] U.S. Cl. ..... 123/516; 123/520

[58] Field of Search ..... 123/516, 518, 123/519, 520

[56] References Cited

U.S. PATENT DOCUMENTS 5,193,511 3/1993 Fujino ..... 123/520
5,220,898 6/1993 Kidokoro ..... 123/520
5,460,142 10/1995 Denz et al. ..... 123/520
5,497,754 3/1996 Ito ..... 123/520
5,617,832 4/1997 Yamazaki et al. ..... 123/520
5,647,335 7/1997 Scheurenbrand et al. ..... 123/520
5,816,223 10/1998 Jamrog et al. ..... 123/520

*Primary Examiner*—Thomas N. Moulis
*Attorney, Agent, or Firm*—Frishauf, Holtz, Goodman, Langer & Chick, P.C.

[57] ABSTRACT

An evaporative emission control system for an internal combustion engine includes of an evaporative fuel passage extending between the fuel tank and the intake system of the engine, and a control valve arranged across the evaporative fuel passage for opening and closing the evaporative fuel passage. The opening of the control valve is controlled such that the interior of the fuel tank is under negative pressure during operation and stoppage of the engine. The opening of the control valve is set to a desired value according to operating conditions of the engine.

17 Claims, 9 Drawing Sheets

START
S1
ENGINE OPERATING ?
NO
YES
S2
UNDER FUEL CUT ?
YES
NO
S5
FETCH Tg
S6
FETCH Pt
S7
FETCH PBA
S8
FETCH NE
S9
DETERMINE Po
S10
Pt>Po ?
NO
YES
S11
PBA<Pt ?
NO
YES
S21
ΔPT←Pt−PBA
S12
RETRIEVE BDR
S23
RETRIEVE ΔPT
S24
CALCULATE DDR
S25
OPEN CONTROL VALVE
CLOSE CONTROL VALVE
S3
END

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for internal combustion engines, and more particularly to an evaporative emission control system, which prevents evaporative fuel generated in the fuel tank from being emitted into the atmosphere by controlling pressure within th e fuel tank to a negative value during operation of the engine as well as during stoppage of the same.

2. Prior Art

Conventional evaporative emission control systems for internal combustion engines for vehicles are generally constructed such that to prevent evaporative fuel generated in the fuel tank from being emitted into the atmosphere, the fuel tank is connected via a canister to the intake system of the engine so that evaporative fuel generated in the fuel tank is absorbed by the canister during stoppage of the engine and desorbed from the canister to be supplied to the engine for combustion during operation of the engine.

Further, there has already been proposed an improved evaporative emission control system of this kind, (for example, in U.S. patent application Ser. No. 09/021,004, assigned to the assignee of the present application,) which negatively pressurizes the interior of the fuel tank during operation of the engine so as to hold the fuel tank under negative pressure not only during operation of the engine but also during stoppage of the same, to thereby prevent evaporative fuel within the fuel tank from being emitted into the atmosphere, even if a filler cap of the fuel tank is removed for refueling.

The proposed system includes a temperature sensor which detects the temperature of fuel within the fuel tank, and a tank internal pressure sensor which detects the pressure within the fuel tank (hereinafter referred to as "the tank internal pressure"), to set the desired pressure value within the fuel tank to an excessively negative value, i.e. a lower value than the actually required value according to the temperature of fuel within the fuel tank, in view of an expected increase in the tank internal pressure Pt. Further, the proposed system includes a control valve arranged in an evaporative fuel passage extending between the fuel tank and the intake system of the engine, for controlling a flow rate of evaporative fuel supplied from the fuel tank to the intake system due to negative pressure within the intake system during operation of the engine. The opening of the control valve is feedback-controlled in response to an output from the tank internal pressure sensor such that the tank internal pressure becomes equal to the desired pressure value. Thus, the tank internal pressure is normally controlled to and held at the desired pressure value.

In the proposed system, however, the negative pressurization of the fuel tank to the desired pressure value is normally carried out during traveling of the vehicle to utilize negative pressure within the intake system of the engine developed during operation of the engine. As a result, when the control valve is opened to start the negative pressurization of the fuel tank, evaporative fuel within the fuel tank is drawn into the intake system to cause a sudden change in the air-fuel ratio of a mixture supplied to the intake system, whereby a shock is generated to degrade drivability and exhaust emission characteristics of the engine.

On the other hand, to avoid degradation of drivability and exhaust emission characteristics of the engine due to the negative pressurization of the fuel tank, a limit value is provided for the flow rate of evaporative fuel to be supplied from the fuel tank to the engine intake system for negative pressurization of the fuel tank. As shown in FIG. 1, the limit value is set, for example, as shown in FIG. 1, to a larger value (liter/min) as at least one of the engine rotational speed and the intake system absolute pressure is higher. The limit value for the flow rate of evaporative fuel for negative pressurization of the fuel tank can limit the upper limit of the negative pressurization rate of the fuel tank.

Even though the limit value is provided, however, if the flow rate of evaporative fuel for negative pressurization is set to the limit value immediately upon the start of the negative pressurization of the fuel tank, a shock can be generated due to a sudden change in the air-fuel ratio of the mixture, resulting in the above-mentioned inconvenience.

On the other hand, when the tank internal pressure is controlled to the desired pressure value, the tank internal pressure approaches the desired value with the lapse of time. During the control, however, when the difference between the intake system pressure and the tank internal pressure becomes smaller, the flow rate of evaporative fuel drawn from the fuel tank into the intake system lowers, and hence the negative pressurization rate of the fuel tank lowers. FIG. 2 shows a change in the tank internal pressure with the lapse of time during the negative pressurization of the fuel tank. As is clear from the figure, since the negative pressurization rate is lowered with the lapse of time, the interior of the fuel tank cannot be negatively pressurized to the desired pressure value in a short time, especially when the vehicle has traveled only over a short distance after refueling. This makes it difficult to always maintain the interior of the fuel tank under negative pressure during operation of the engine as well as during stoppage of the same.

Thus, the proposed system has a problem of contradictory requirements, i.e. restraint of the negative pressurization rate of the fuel tank and increase of the same.

SUMMARY OF THE INVENTION

It is a first object of the invention to provide an evaporative emission control system for internal combustion engines which is capable of preventing a sudden change in the air-fuel ratio of the mixture within the intake system at the start of negative pressurization of the fuel tank utilizing negative pressure within the intake system, to thereby prevent degradation of drivability and exhaust emission characteristics of the engine.

It is a second object of the invention to provide an evaporative emission control system for internal combustion engines which is capable of optimizing the flow rate of evaporative fuel to be supplied from the fuel tank to the intake system for negative pressurization of the fuel tank during negative pressurization of the fuel tank utilizing the negative pressure within the intake system, as well as capable of negatively pressurizing the fuel tank to the desired pressure value in a short time.

To attain the first object, the present invention provides an evaporative emission control system for an internal combustion engine having a fuel tank, and an intake system, comprising:

- an evaporative fuel passage extending between the fuel tank and the intake system;
- a control valve arranged across the evaporative fuel passage for opening and closing the evaporative fuel passage;
- control means for controlling opening of the control valve such that an interior of the fuel tank is under negative pressure during operation and stoppage of the engine; and operating condition-detecting means for detecting operating conditions of the engine;

wherein the control means sets the opening of the control valve to a desired value according to operating conditions of the engine detected by the operating condition-detecting means.

With this arrangement, evaporative fuel in the fuel tank can be prevented from being suddenly drawn into the intake system, to thereby avoid a shock and prevent degradation of drivability. Further, the air-fuel ratio of a mixture in the intake system can be prevented from being suddenly changed, to thereby prevent degradation of exhaust emission characteristics of the engine.

Preferably, the operating condition-detecting means includes a rotational speed sensor for detecting rotational speed of the engine, and a pressure sensor for detecting pressure within the intake system, the control means setting the desired value of the opening of the control valve to a larger value as at least one of the rotational speed of the engine and the pressure within the intake system is larger.

With this arrangement, evaporative fuel within the fuel tank can be positively prevented from being suddenly drawn into the intake system.

Preferably, the control means progressively increases the opening of the control valve until it reaches the desired value, after start of negative pressurization of the fuel tank.

With this arrangement, evaporative fuel within the fuel tank can be more positively prevented from being suddenly drawn into the intake system.

More preferably, the control means includes counter means, the control means increasing the opening of the control valve by a predetermined amount until it reaches the desired value, whenever a count value counted by the counter means reaches a predetermined value.

To attain the second object, the present invention provides an evaporative emission control system for an internal combustion engine having a fuel tank, and an intake system, comprising:

an evaporative fuel passage extending between the fuel tank and the intake system;

a control valve arranged across the evaporative fuel passage for opening and closing the evaporative fuel passage;

a first pressure sensor for detecting pressure within the fuel tank;

control means for controlling opening of the control valve such that an interior of the fuel tank is under negative pressure during operation and stoppage of the engine; and a second pressure sensor for detecting pressure within the intake system;

wherein the control means sets the opening of the control valve, based on a difference between the pressure within the fuel tank detected by the first pressure sensor and the pressure within the intake system detected by the second pressure sensor.

With this arrangement, during negative pressurization of the fuel tank, as the difference between the pressure within the fuel tank and the pressure within the intake system is smaller, a decrease in a flow rate of evaporative fuel for negative pressurization due to a decrease in the difference can be restrained, and hence a negative pressurization rate can be optimized and the fuel tank can be negatively pressurized in a short time without fail.

Preferably, the control means sets the opening of the control valve to a larger value as the difference between the pressure within the fuel tank detected by the first pressure sensor and the pressure within the intake system detected by the second pressure sensor is smaller.

With this arrangement, the decrease in the flow rate of evaporative fuel for negative pressurization due to a decrease in the pressure difference can be positively restrained.

Preferably, the evaporative emission control system includes operating condition-detecting means for detecting operating conditions of the engine, and wherein the control means sets the opening of the control valve, based on the difference between the pressure within the fuel tank detected by the first pressure sensor and the pressure within the intake system detected by the second pressure sensor and operating conditions of the engine detected by the operating condition-detecting means.

With this arrangement, the opening of the control valve can be suitably set according to operating conditions of the engine.

More preferably, the operating condition-detecting means includes the second pressure sensor, and a rotational speed sensor for detecting rotational speed of the engine, the control means determining a basic value of the opening of the control valve according to the pressure within the intake system detected by the second pressure sensor and the rotational speed of the engine detected by the rotational speed sensor, and correcting the basic value according to the difference between the pressure within the fuel tank detected by the first pressure sensor and the pressure within the intake system detected by the second pressure sensor.

Further preferably, the control means sets the basic value of the opening of the control valve to a larger value as at least one of the pressure within the intake system and the rotational speed of the engine is larger.

With this arrangement, the opening of the control valve can be suitably set according to the pressure within the intake system and the rotational speed of the engine.

Advantageously, the control means sets a correction coefficient for correcting the difference between the pressure within the fuel tank detected by the first pressure sensor and the pressure within the intake system detected by the second pressure sensor, the correction coefficient becoming closer to 1 as the difference is larger, and becoming larger at an increased rate as the difference becomes closer to 0.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 3:
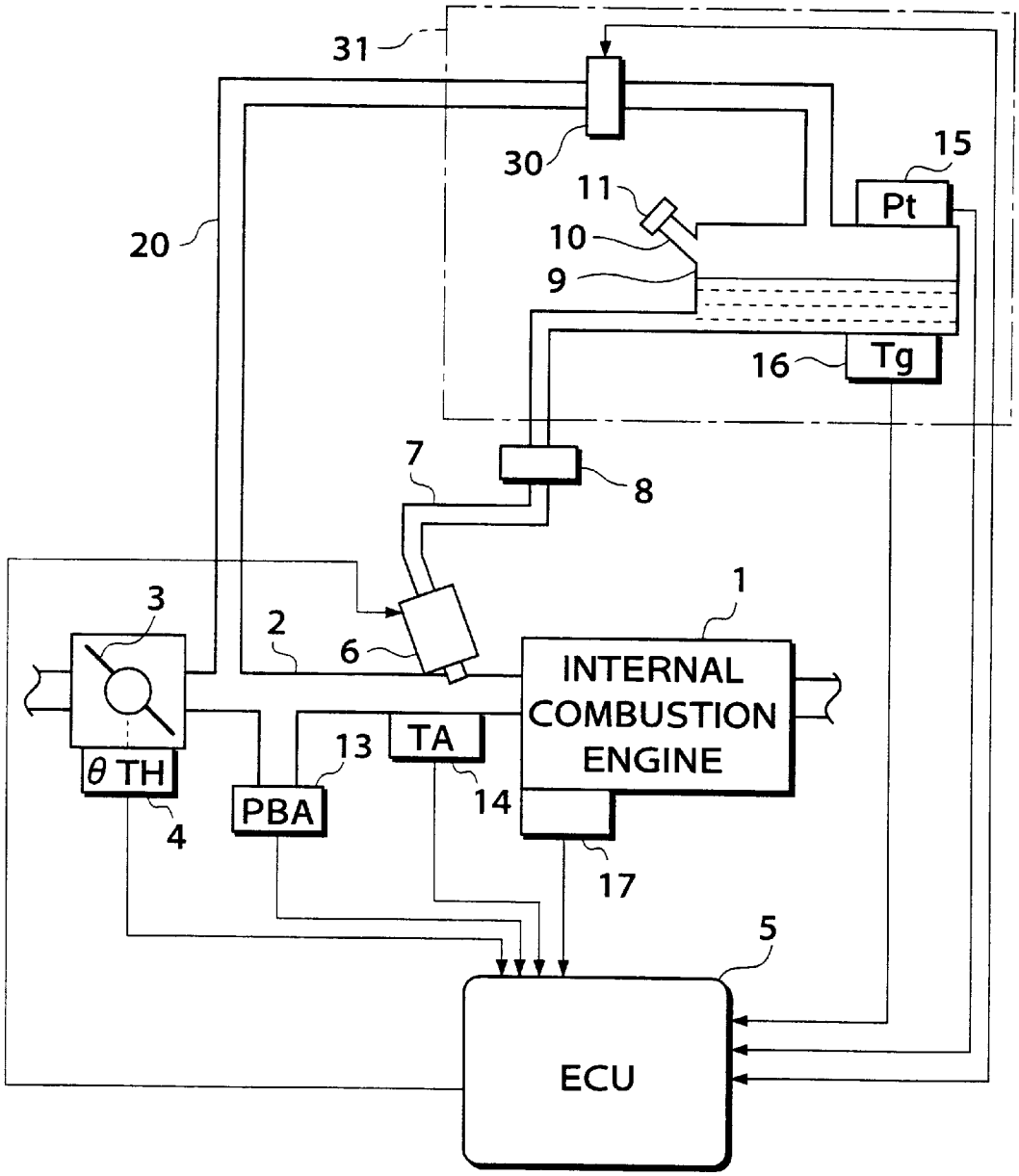
FIG. 3 is a block diagram schematically showing the entire arrangement of an internal combustion engine and an evaporative emission control system therefor, according to a first embodiment of the invention.

Referring first to FIG. 3, there is illustrated the entire arrangement of an internal combustion engine and an evaporative emission control system therefor, according to a first embodiment of the invention.

In the figure, reference numeral 1 designates an internal combustion engine (hereinafter simply referred to as "the engine") having four cylinders, not shown, for instance. Arranged in an intake pipe 2 of the engine is a throttle valve 3, to which is connected a throttle valve opening (θTH) sensor 4 for supplying an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location intermediate between the engine 1 and the throttle valve 3 and slightly upstream of an intake valve, not shown. The fuel injection valves 6 are connected to a fuel tank 9 via a fuel supply pipe 7 with a fuel pump 8 arranged thereacross. The fuel tank 9 has an oil inlet 10 for refueling, which is provided with a filler cap 11 mounted thereon.

The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA as outside air temperature. Inserted into the fuel tank 9 are a tank internal pressure (Pt) sensor 15 for detecting pressure (absolute pressure) Pt within the fuel tank 9 (hereinafter referred to as "the tank internal pressure"), and a fuel temperature (Tg) sensor 16 for detecting temperature Tg of fuel in the fuel tank 9.

An engine rotational speed (NE) sensor 17 is arranged in facing relation to a camshaft or a crankshaft of the engine 1, neither of which is shown. The NE sensor 17 generates a pulse as a TDC signal pulse at each of predetermined crank angles whenever the crankshaft rotates through 180 degrees. Signals indicative of the sensed parameter values from the sensors 13 to 17 are supplied to the ECU 5.

Next, an essential part 31 of the evaporative emission control system will be described, which is comprised of the fuel tank 9, an evaporative fuel passage 20, and a control valve 30.

The fuel tank 9 is connected through the evaporative fuel passage 20 to the intake pipe 2 at a location downstream of the throttle valve 3. The control valve 30 is arranged across the evaporative fuel passage 20 for opening and closing the passage 20 to control the tank internal pressure. The control valve 30 is an electromagnetic valve which has its opening controlled according to the on-off duty ratio of a control signal supplied from the ECU 5 to control the flow rate of evaporative fuel to be supplied from the fuel tank 9 to the intake pipe 2 for negative pressurization of the fuel tank 9. Alternatively, the control valve 30 may be an electromagnetic valve of a linear control type which has its opening linearly changed.

The ECU 5 is comprised of an input circuit having the functions of shaping the waveforms of input signals from various sensors, shifting the voltage levels of sensor output signals to a predetermined level, converting analog signals from analog-output sensors to digital signals, and so fourth, a central processing unit (hereinafter referred to as "the CPU"), a memory circuit storing operational programs which are executed by the CPU and for storing results of calculations therefrom, etc., and an output circuit which delivers driving or control signals to the fuel injection valves 6 and the control valve 30.

The CPU of the ECU 5 operates in response to output signals from various sensors including the θTH sensor 4 and the PBA sensor 13, to control an amount of fuel supplied to the engine 1, etc., and determines the duty ratio of the control signal for the control valve 30 in response to output signals from the PBA sensor 13, the NE sensor 17, etc.

Figure 4:
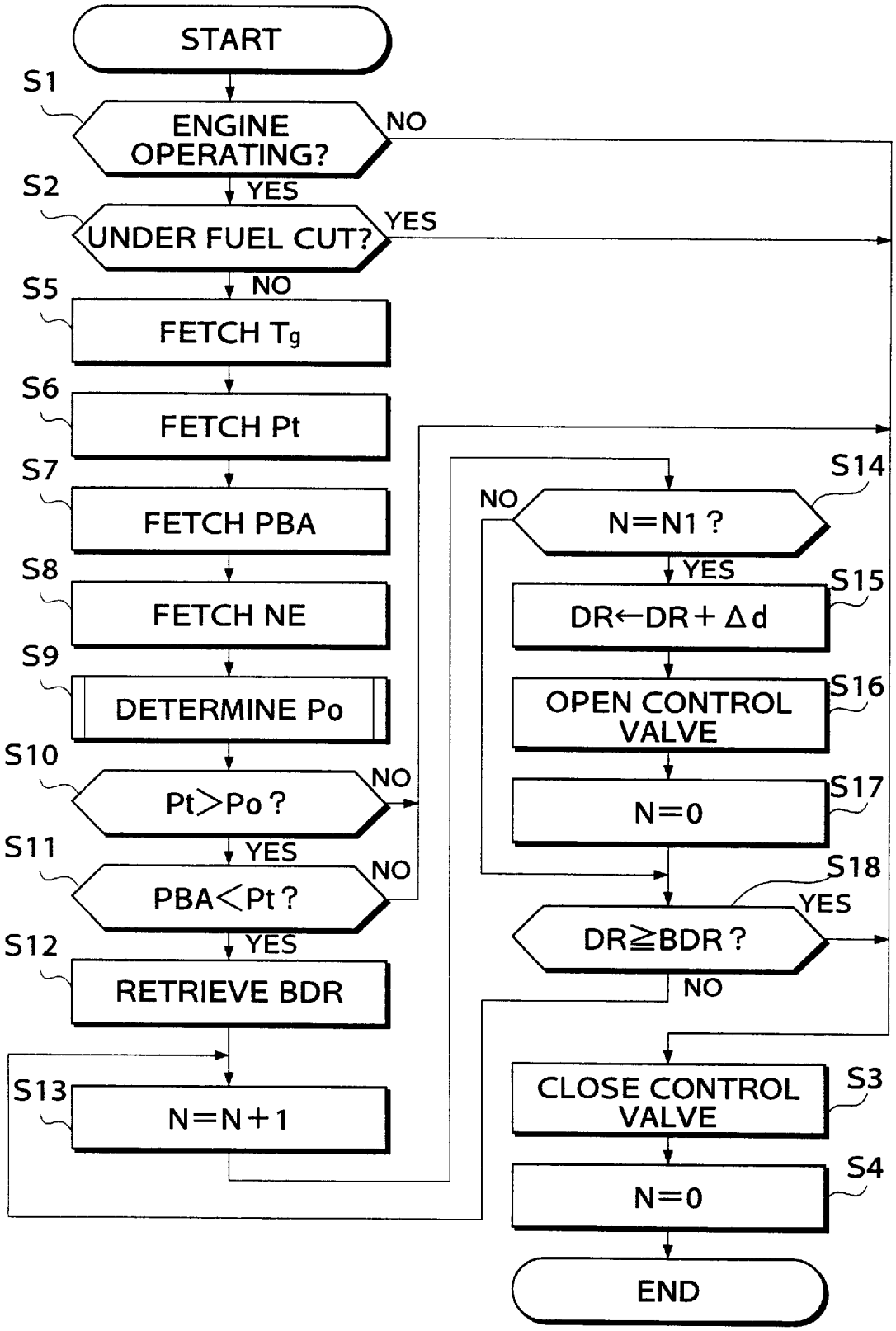
FIG. 4 is a flowchart showing a program for carrying out an evaporative emission control process according to the first embodiment.

FIG. 4 shows a routine for carrying out an evaporative emission control process according to the first embodiment, which is executed at predetermined time intervals (e.g. 10 msec).

First, at a step S1, it is determined whether or not the engine 1 is operating, e.g. by detecting cranking of the same, and then it is determined at a step S2 whether or not the engine 1 is under fuel cut. If it is determined at the step S1 that the engine 1 is in stoppage or it is determined at the step S2 that the engine 1 is under fuel cut, the control valve 30 is closed to hold the interior of the fuel tank 9 under negative pressure which has been controlled to a desired pressure value Po, referred to hereinafter, at a step S3, and a count value N of a counter, referred to hereinafter, is set to 0 at a step S4, followed by terminating the present routine.

If the engine is operating and at the same time the engine 1 is not under fuel cut at the respective steps S1 and S2, the fuel temperature Tg within the fuel tank 9 detected by the Tg sensor 16 is fetched at a step S5, and then the internal pressure Pt detected by the Pt sensor 15 is fetched at a step S6. Further, the intake pipe absolute pressure PBA detected by the PBA sensor 13 is fetched at a step S7, and then the engine rotational speed NE detected by the NE sensor 11 is fetched at a step S8.

Then, the desired pressure value (absolute pressure value) Po (mmHg) within the fuel tank 9 is determined based on the above fetched parameters, i.e. the fuel temperature Tg within the fuel tank 9 and the tank internal pressure Pt, in a predetermined manner described e.g. in U.S. patent application Ser. No. 09/021,004, at a step S9. The desired pressure value Po is a value at which the interior of the fuel tank 9 is excessively negatively pressurized to a higher degree than the actually required negative pressure in view of an expected increase in the tank internal pressure Pt so that the interior of the fuel tank 9 can be held under negative pressure even during stoppage of the engine 1. Such an expected increase in the tank internal pressure Pt is caused by the following factors: That is, the fuel contains ingredients which evaporate at temperatures lower than the fuel temperature, due to a heat held by the fuel at the fuel temperature, and part of the fuel evaporates with a rise in the fuel temperature caused by elevation of the outside air temperature TA.

Then, it is determined at a step S10 whether or not the tank internal pressure Pt is higher than the desired pressure value Po. If Pt≦Po holds, the fuel tank 9 need not be further negatively pressurized, and then the steps S3 and S4 are executed, followed by terminating the present routine.

On the other hand, if Pt>Po holds at the step S10, the program proceeds to a step S11, wherein it is determined whether or not the intake pipe absolute pressure PBA is lower than the tank internal pressure Pt. If PBA≧Pt holds, the fuel tank 9 cannot be further negatively pressurized by the intake pipe absolute pressure PBA, the steps S3 and S4 are executed, followed by terminating the present routine.

Figure 5:
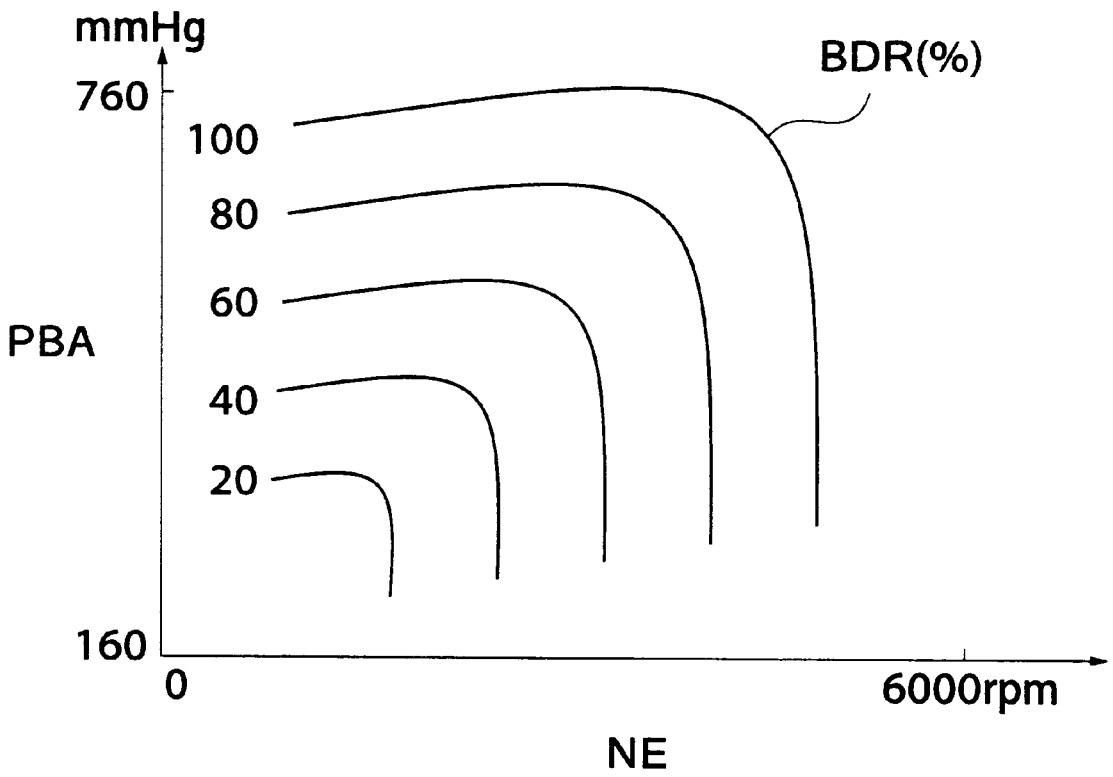
FIG. 5 shows a table for determining a reference duty ratio BDR of a control valve appearing in FIG. 3.

If PBA<Pt holds at the step S11, a basic duty ratio BDR (%) of the control valve 30 as a final desired duty ratio is retrieved from a table shown in FIG. 5, according to the engine rotational speed NE and the intake pipe absolute pressure PBA at a step S12. As is clear from the figure, the basic duty ratio BDR of the control valve 30 is set to a larger value as at least one of the engine rotational speed NE and the intake pipe absolute pressure PBA is higher. The basic duty ratio BDR assumes such a value that the tank internal pressure Pt is not higher than the desired pressure value Po (mmHg) with a pressure loss of the evaporative fuel passage 20 being taken into consideration, as well.

At the following step S13, the count value N of the counter is incremented by 1, and it is determined at a step S14 whether or not the count value N has reached a predetermined value N1 (e.g. 100). In the present embodiment, whenever the count value N of the counter reaches the predetermined value N1, a predetermined value Δd (e.g. 5%) is added to the duty ratio DR of the control valve 30, at a step S15, hereinafter referred to. When this question is first made, the count value N has not reached the predetermined value N1, and therefore the program jumps over steps S15 to S17 to a step S18. On the other hand, if N=N1 holds at the step S14, the program proceeds to the step S15, wherein the predetermined value Δd is added to the duty ratio DR of the control valve 30.

Then, at the step S16, the control valve 30 is opened to a degree corresponding to the duty ratio DR calculated at the step S15, and the count value N is set to 0 at the step S17.

Further, it is determined at the step S18 whether or not the duty ratio DR of the control valve 30 is larger than the basic duty ratio BDR retrieved at the step S12. If DR≧BDR holds, which means that the duty ratio DR of the control valve 30 has reached the basic duty ratio BDR, the steps S3 and S4 are executed, followed by terminating the present routine. On the other hand, if DR<BDR holds at the step S18, the above steps S13 to S17 are repeatedly executed.

Figure 6:
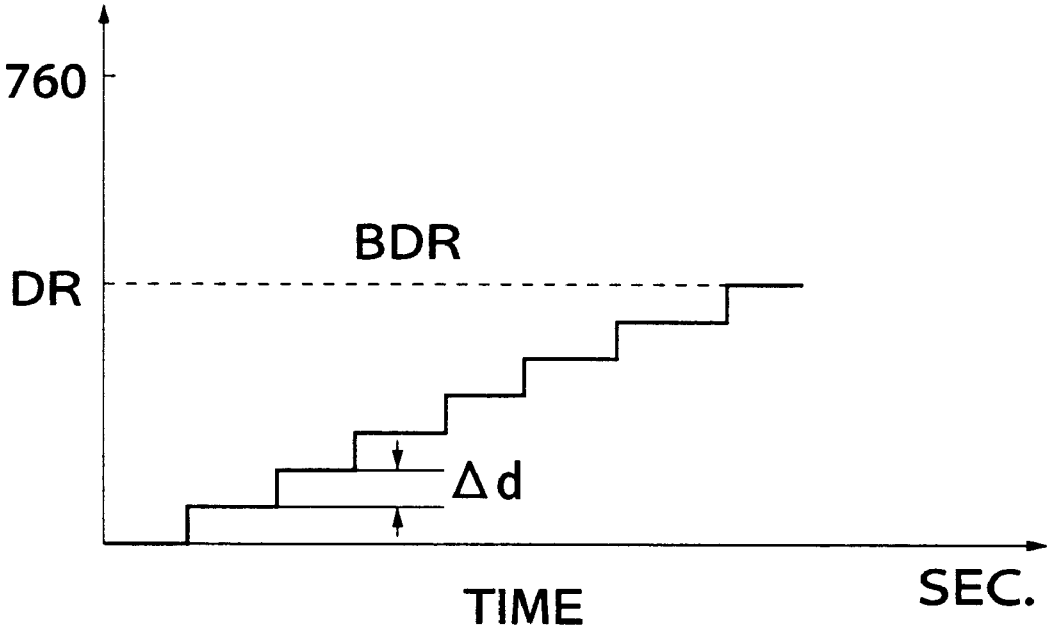
FIG. 6 is a graph showing a change in a duty ratio DR of the control valve with the lapse of time.

FIG. 6 shows a change in the duty ratio DR of the control valve 30, caused by execution of the process of FIG. 4. As shown in the figure, the duty ratio DR is progressively increased to the basic duty ratio BDR.

According to the present embodiment, as described above, by controlling the duty ratio DR of the control valve 30 to the basic duty ratio BDR during operation of the engine 1, negative pressure within the intake pipe 2 is introduced into the fuel tank 9, to thereby control and hold the tank internal pressure Pt to and at the desired pressure value Po. As a result, the interior of the fuel tank 9 can be held under negative pressure not only during operation of the engine 1 but also during stoppage of the same, whereby evaporative fuel in the fuel tank 9 can be prevented from being emitted into the atmosphere even if the filler cap 11 is removed for refueling. Further, by controlling the duty ratio DR of the control valve 30 such that it is progressively increased by the predetermined value Δd at predetermined time intervals until it reaches the basic duty ratio BDR retrieved at the step S12, a large amount of evaporative fuel in the fuel tank 9 can be prevented from being suddenly drawn into the intake pipe 2, to prevent a sudden change in the air-fuel ratio of the mixture in the intake pipe 2. As a result, a shock can be avoided, to thereby prevent degradation of drivability and exhaust emission characteristics of the engine.

Next, a second embodiment of the invention will be described. In the second embodiment, the construction of the evaporative emission control system is identical with that employed in the first embodiment described above, and therefore description thereof is omitted.

Figure 7:
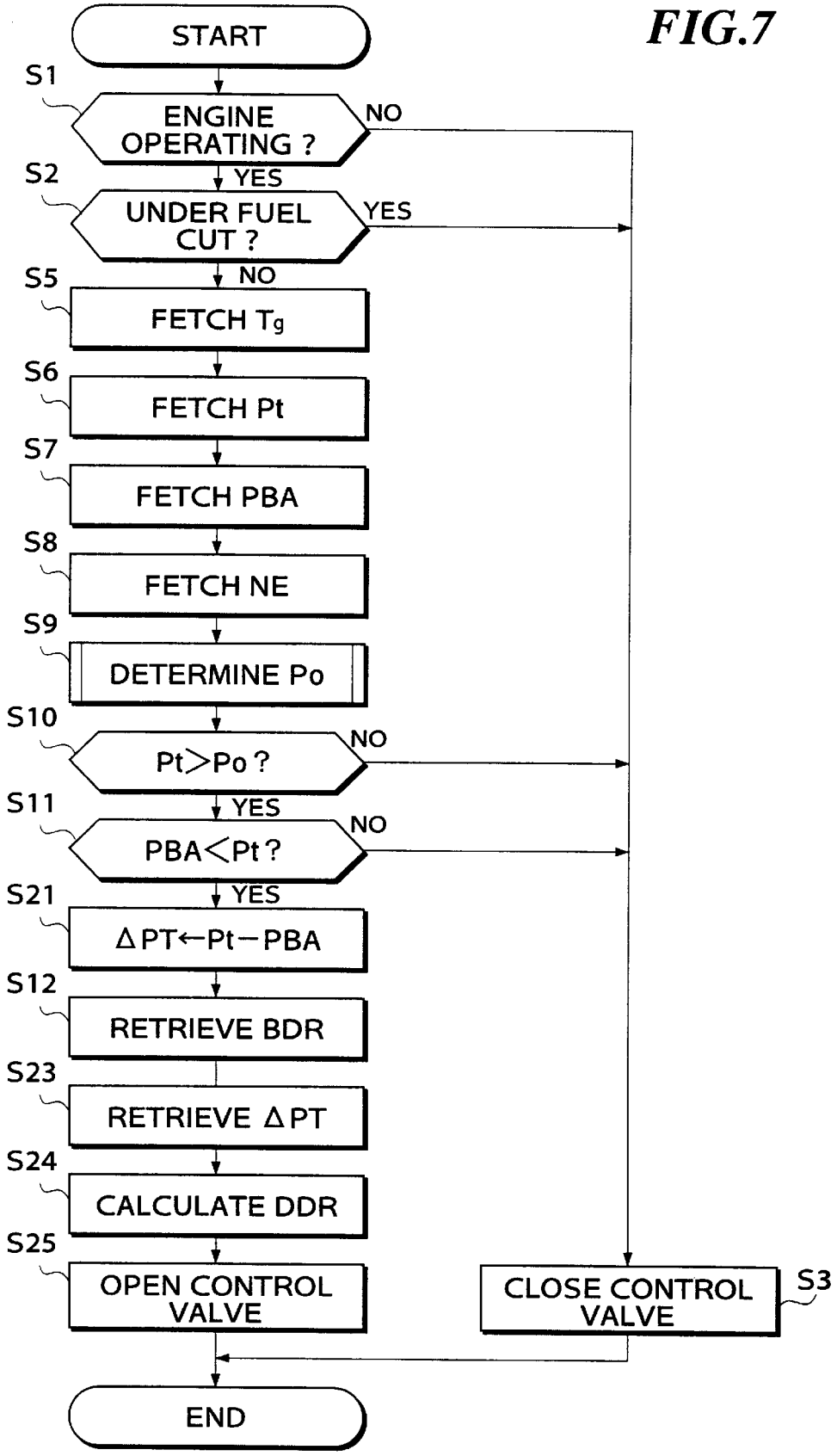
FIG. 7 is a flowchart showing a program for carrying out an evaporative emission control process according to a second embodiment of the invention.

FIG. 7 shows a process for carrying out an evaporative emission control process according to the second embodiment, which is executed at predetermined time intervals (e.g. 10 msec). In FIG. 7, corresponding steps to those in FIG. 4 are designated by identical step numbers, and only steps different from those in FIG. 4 and steps associated therewith will be described hereinbelow.

If it is determined at the steps S1 and S2 that the engine 1 is in stoppage or under fuel cut, the control valve 30 is closed at the step S3 to hold the pressure within the fuel tank at negative pressure which has been controlled to the desired pressure value Po, followed by terminating the present routine. In the present embodiment, the counter for counting the count N employed in the first embodiment is not employed.

On the other hand, if the engine is operating and at the same time the engine 1 is not under fuel cut at the steps S1 and S2, the steps S5 to S9 are executed. Then, if Pt≦Po or PBA≧Pt holds at the step S10 or S11, the control valve 30 is closed at the step S3, followed by terminating the present routine.

If Pt>Po holds and at the same time PBA<Pt holds at the steps S10 and S1, a pressure difference ΔPT between the tank internal pressure Pt and the intake pipe absolute pressure PBA is calculated at a step S21. Then, at the step S12, the basic duty ratio BDR of the control valve 30 is retrieved from the table of FIG. 5 according to the engine rotational speed NE and the intake pipe absolute pressure PBA, in the same manner as described hereinbefore with reference to the first embodiment.

Figure 8:
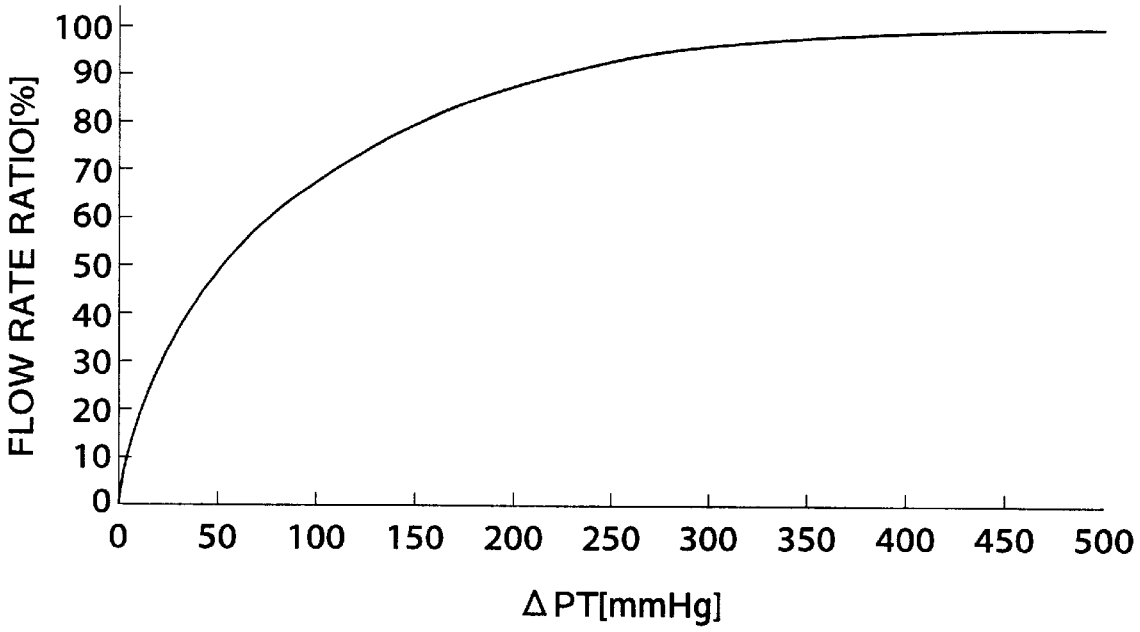
FIG. 8 is a graph useful in explaining a change in a flow rate ratio with a pressure difference ΔPT.

Even if the control valve 30 is controlled based on the basic duty ratio BDR, however, the tank internal pressure Pt lowers toward the intake pipe absolute pressure PBA with the lapse of time, resulting in a progressive decrease in the flow rate of evaporative fuel for negative pressurization from the fuel tank 9 into the intake pipe 2. This decrease in the flow rate of evaporative fuel for negative pressurization is expressed as a flow rate ratio (%: percentage with the flow rate of evaporative fuel for negative pressurization assumed to be 100% when the pressure difference ΔPT is 500 mmHg) of evaporative fuel drawn from the fuel tank 9, as shown in FIG. 8. As seen in the figure, the flow rate ratio becomes smaller as the pressure difference ΔPT is smaller. That is, even if the control valve 30 is controlled to the basic duty ratio BDR, the flow rate (liter/min) of evaporative fuel drawn from the fuel tank 9 for negative pressurization becomes progressively smaller, whereby the negative pressurization rate of the fuel tank 9 lowers.

Figure 9:
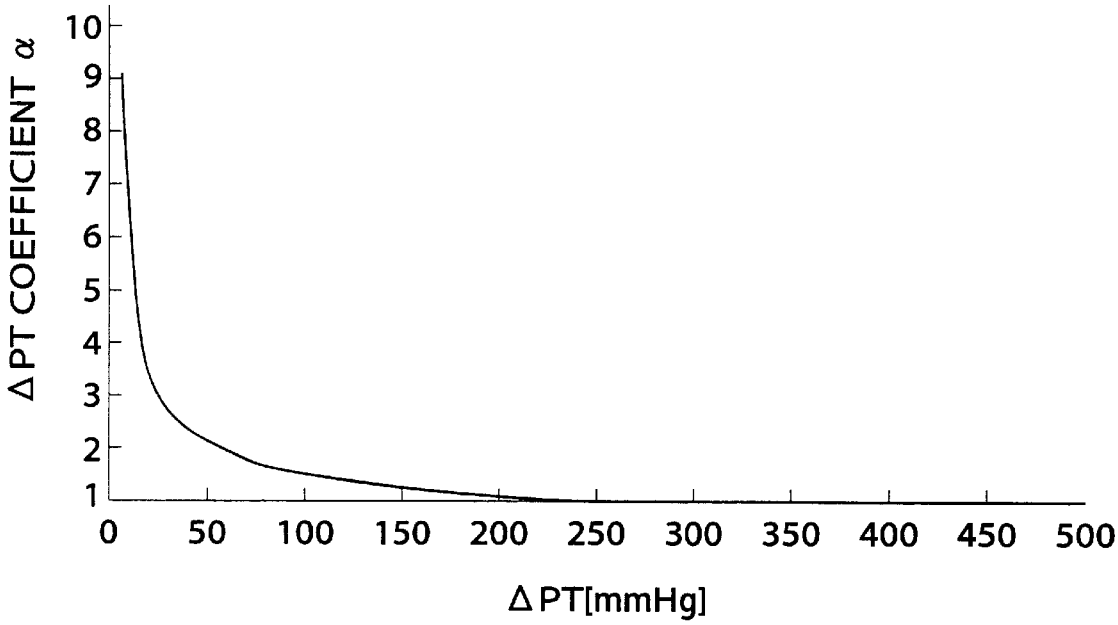
FIG. 9 shows a table for determining a ΔPT coefficient α according to the pressure difference ΔPT.

FIG. 9 shows a table for determining a ΔPT coefficient α according to the pressure difference ΔPT, which is used to offset the decrease in the flow rate ratio as shown in FIG. 8. In the figure, the ΔPT coefficient α presents a hyperbolic characteristic which becomes closer to 1 as the pressure difference ΔPT is larger while it becomes larger at an increased rate as the pressure difference ΔPT becomes closer to 0 below 100 mmHg.

Referring again to FIG. 7, at a step S23, the ΔPT coefficient α is retrieved from the table of FIG. 9 according to the pressure difference ΔPT. Then, at a step S24, the basic duty ratio BDR is multiplied by the thus retrieved ΔPT coefficient α (BDR×α), to calculate a driving duty ratio DDR of the control valve 30. Then, the control valve 30 is opened based on the thus calculated driving duty ratio DDR at a step S25, followed by terminating the present routine.

According to the present embodiment, as described above, the ΔPT coefficient α is set so as to sharply increase in a region where the pressure difference ΔPT is close to 0. Therefore, while the pressure difference ΔPT between the tank internal pressure Pt and the intake pipe absolute pressure PBA becomes smaller, the basic duty ratio BDR of the control valve 30 determined according to at least one of the engine rotational speed NE and the intake pipe absolute pressure PBA is multiplied by the ΔPT coefficient α to offset the decrease in the flow rate ratio. As a result, a decrease in the flow rate of evaporative fuel for negative pressurization due to the decrease in the pressure difference ΔPT can be restrained, and hence the fuel tank 9 can be negatively pressurized to the desired pressure value Po in a short time without fail.

Figure 1:
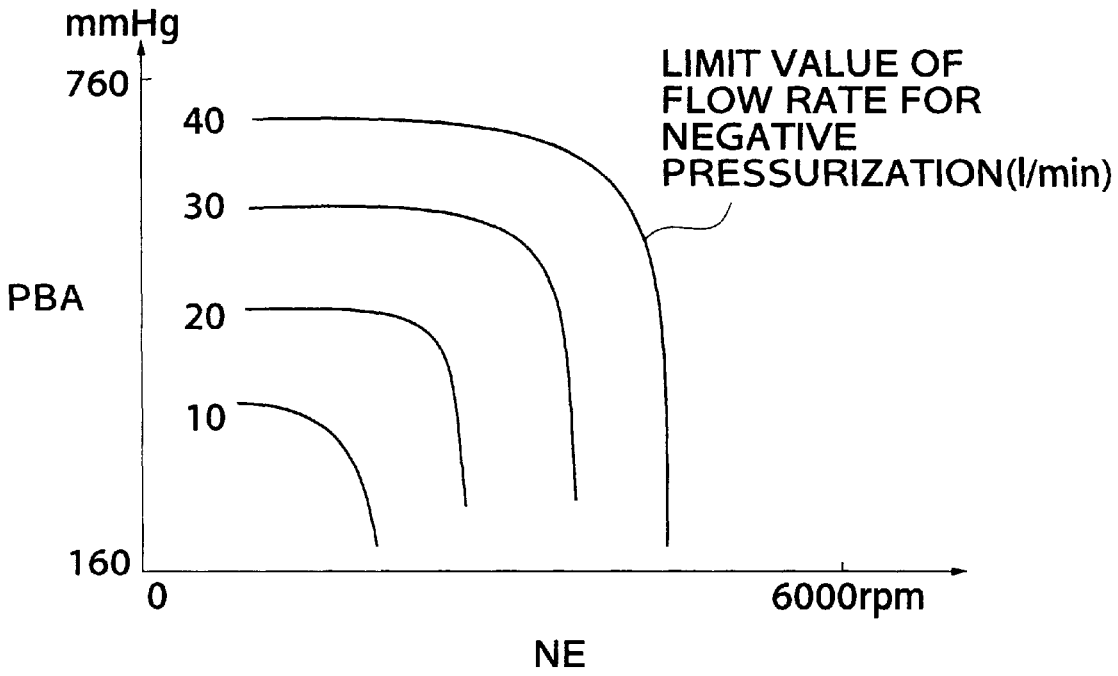
FIG. 1 is a graph showing how to set a limit value of a flow rate of evaporative fuel for negative pressurization according to U.S. Ser. No. 09/021,004.
Figure 2:
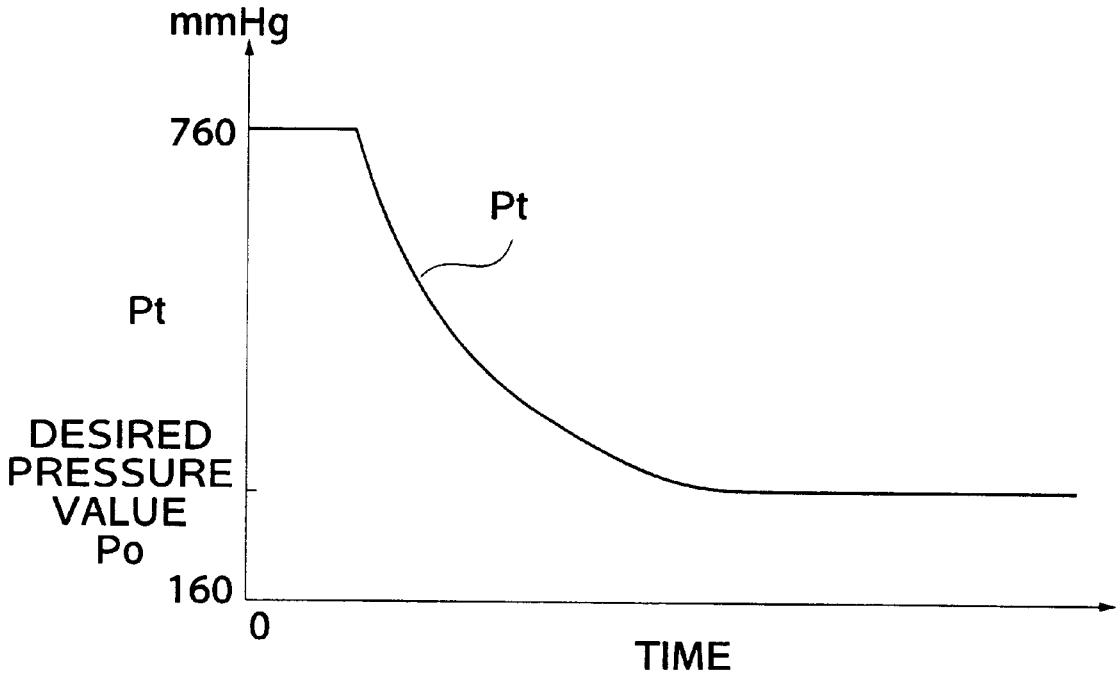
FIG. 2 is a graph showing a change in tank internal pressure Pt during negative pressurization according to U.S. Ser. No. 09/021,004.

On the other hand, in a region where the pressure difference ΔPT is relatively large, the ΔPT coefficient α is set to a value almost equal to 1, and therefore the driving duty ratio DDR of the control valve 30 can be set to an optimum value based on the basic duty ratio BDR determined according to the engine rotational speed NE and the intake pipe absolute pressure PBA. Further, as stated before, the basic duty ratio BDR is set to such a value that the flow rate of evaporative fuel for negative pressurization is not larger than than the limit value depicted in FIG. 1, with the pressure loss of the evaporative fuel passage 20 taken into consideration. As a result, in a region where the pressure difference ΔPT is relatively large, the flow rate of evaporative fuel for negative pressurization is restrained, preventing a sudden change in the air-fuel ratio of the mixture within the intake pipe 2, to thereby prevent degradation of exhaust emission characteristics and drivability of the engine.

What is claimed is:

1. An evaporative emission control system for an internal combustion engine having a fuel tank, and an intake system, said control system comprising:

an evaporative fuel passage extending between said fuel tank and said intake system;

a control valve arranged across said evaporative fuel passage for opening and closing said evaporative fuel passage;

control means for controlling opening of said control valve such that an interior of said fuel tank is under negative pressure during operation and stoppage of said engine; and operating condition-detecting means for detecting operating conditions of said engine;

wherein said control means sets the opening of said control valve to a desired value according to the operating conditions of said engine detected by said operating condition-detecting means.

2. An evaporative emission control system as claimed in claim 1, wherein said operating condition detecting means includes a rotational speed sensor for detecting a rotational speed of said engine, and a pressure sensor for detecting a pressure within said intake system, and wherein said control means sets the opening of said control valve to a larger value as at least one of the rotational speed of said engine and the pressure within said intake system increases.

3. An evaporative emission control system as claimed in claim 1, wherein said control means progressively increases the opening of said control valve until said desired value is reached, after a start of negative pressurization of said fuel tank.

4. An evaporative emission control system as claimed in claim 3, wherein said control means includes a counter, and wherein said control means increases said opening of said control valve by a predetermined amount until said desired value is reached, whenever a count value counted by said counter reaches a predetermined value.

5. An evaporative emission control system for an internal combustion engine having a fuel tank, and an intake system, said control system comprising:

an evaporative fuel passage extending between said fuel tank and said intake system;

a control valve arranged across said evaporative fuel passage for opening and closing said evaporative fuel passage;

a first pressure sensor for detecting a pressure within said fuel tank;

control means for controlling opening of said control valve such that an interior of said fuel tank is under negative pressure during operation and stoppage of said engine; and a second pressure sensor for detecting a pressure within said intake system;

wherein said control means sets the opening of said control valve based on a difference between the pressure within said fuel tank detected by said first pressure sensor and the pressure within said intake system detected by said second pressure sensor.

6. An evaporative emission control system as claimed in claim 5, wherein said control means sets the opening of said control valve to a larger value as said difference between the pressure within said fuel tank detected by said first pressure sensor and the pressure within said intake system detected by said second pressure sensor decreases.

7. An evaporative emission control system as claimed in claim 5, including operating condition-detecting means for detecting operating conditions of said engine, and wherein the control means sets the opening of said control valve based on said difference between the pressure within said fuel tank detected by said first pressure sensor and the pressure within said intake system detected by said second pressure sensor and the operating conditions of said engine detected by said operating condition-detecting means.

8. An evaporative emission control system as claimed in claim 7, wherein said operating condition-detecting means includes said second pressure sensor, and a rotational speed sensor for detecting a rotational speed of said engine, and wherein said control means determines a basic value of the opening of said control valve according to the pressure within said intake system detected by said second pressure sensor and the rotational speed of said engine detected by said rotational speed sensor, and corrects said basic value according to said difference between the pressure within said fuel tank detected by said first pressure sensor and the pressure within said intake system detected by said second pressure sensor.

9. An evaporative emission control system as claimed in claim 8, wherein said control means sets said basic value of the opening of said control valve to a larger value as at least one of the pressure within said intake system and the rotational speed of said engine increases.

10. An evaporative emission control system as claimed in claim 8, wherein said control means sets a correction coefficient for correcting said difference between the pressure within said fuel tank detected by said first pressure sensor and the pressure within said intake system detected by said second pressure sensor, said correction coefficient being set closer to 1 as said difference increases, and being set larger at an increased rate as said difference becomes closer to 0.

11. An evaporative emission control system as claimed in claim 2, wherein said control means progressively increases the opening of said control valve until said desired value is reached, after start of negative pressurization of said fuel tank.

12. An evaporative emission control system as claimed in claim 11, wherein said control means includes a counter, and wherein said control means increases said opening of said control valve by a predetermined amount until said desired value is reached, whenever a count value counted by said counter reaches a predetermined value.

13. An evaporative emission control system as claimed in claim 6, including operating condition-detecting means for detecting operating conditions of said engine, and wherein the control means sets the opening of said control valve based on said difference between the pressure within said fuel tank detected by said first pressure sensor and the pressure within said intake system detected by said second pressure sensor and the operating conditions of said engine detected by said operating condition-detecting means.

14. An evaporative emission control system as claimed in claim 13, wherein said operating condition-detecting means includes said second pressure sensor, and a rotational speed sensor for detecting a rotational speed of said engine, and wherein said control means determines a basic value of the opening of said control valve according to the pressure within said intake system detected by said second pressure sensor and the rotational speed of said engine detected by said rotational speed sensor, and corrects said basic value according to said difference between the pressure within said fuel tank detected by said first pressure sensor and the pressure within said intake system detected by said second pressure sensor.

15. An evaporative emission control system as claimed in claim 14, wherein said control means sets said basic value of the opening of said control valve to a larger value as at least one of the pressure within said intake system and the rotational speed of said engine increases.

16. An evaporative emission control system as claimed in claim 15, wherein said control means sets a correction coefficient for correcting said difference between the pressure within said fuel tank detected by said first pressure sensor and the pressure within said intake system detected by said second pressure sensor, said correction coefficient being set closer to 1 as said difference increases, and being set larger at an increased rate as said difference becomes closer to 0.

17. An evaporative emission control system as claimed in claim 9, wherein said control means sets a correction coefficient for correcting said difference between the pressure within said fuel tank detected by said first pressure sensor and the pressure within said intake system detected by said second pressure sensor, said correction coefficient being set closer to 1 as said difference increases, and being set larger at an increased rate as said difference becomes closer to 0.

* * * * *